US010503093B2

(12) United States Patent
Yasuno

(10) Patent No.: US 10,503,093 B2
(45) Date of Patent: Dec. 10, 2019

(54) INFORMATION PROCESSING APPARATUS THAT CORRECTS IMAGE DATA, AND IMAGE FORMING APPARATUS CONNECTED THERETO

(71) Applicant: CANON KABUSHIKI KAISHA, Tokyo (JP)

(72) Inventor: Takashi Yasuno, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/198,926

(22) Filed: Nov. 23, 2018

(65) Prior Publication Data

US 2019/0163086 A1 May 30, 2019

(30) Foreign Application Priority Data

Nov. 28, 2017 (JP) ..... 2017-227960

(51) Int. Cl.
*G03G 15/043* (2006.01)
*G03G 15/00* (2006.01)

(52) U.S. Cl.
CPC ..... *G03G 15/043* (2013.01); *G03G 15/5029* (2013.01)

(58) Field of Classification Search
CPC ..... G03G 15/043; G03G 15/5029
See application file for complete search history.

(56) References Cited

U.S. PATENT DOCUMENTS

2015/0241811 A1* 8/2015 Shirahata ..... G02B 26/124 399/51
2017/0285510 A1* 10/2017 Furuta ..... G03G 15/043

FOREIGN PATENT DOCUMENTS

JP 2006142716 A 6/2006

* cited by examiner

*Primary Examiner* — Susan S Lee
(74) *Attorney, Agent, or Firm* — Rossi, Kimms & McDowell LLP

(57) ABSTRACT

An information processing apparatus capable of specifying a reflection surface cheaply and accurately. A connected image forming apparatus generates a signal having first and second levels on the basis of information about reflection surfaces of a polygon mirror so that a period of the first level corresponding to a predetermined reflection surface becomes longer than that corresponding to the other reflection surfaces. The information processing apparatus detects a first timing at which the signal changes to the first level from the second level and a second timing at which the signal changes to the second level from the first level, specifies the reflection surface based on a period from the first timing to the second timing that is detected first after elapsing a first period from the first timing, and corrects the image data corresponding to the reflection surface according to the surface information and correction data.

8 Claims, 11 Drawing Sheets

INFORMATION PROCESSING APPARATUS THAT CORRECTS IMAGE DATA, AND IMAGE FORMING APPARATUS CONNECTED THERETO

BACKGROUND OF THE INVENTION

Field of the Invention

The present invention relates to an information processing apparatus that corrects image data, and an image forming apparatus to which the information processing apparatus is connected.

Description of the Related Art

An image forming apparatus with an electrophotographic system using laser forms a latent image by scanning a photosensitive member with a laser beam deflected by a rotating polygon mirror. Surface shapes of a polygon mirror that deflects a laser beam differ to one another. When surface shapes differ to one another, a latent image formed by a laser beam deflected by the respective surfaces will be distorted. Japanese Laid-Open Patent Publication (Kokai) No. 2006-142716 (JP 2006-142716A) discloses a technique for correcting a scanning position using correction data prepared for every reflective surface.

A specifying unit that specifies a reflection surface of a polygon mirror and an image processing unit that corrects a scanning position for every reflection surface may be provided in different substrates, respectively. In such a case, an exclusive signal line for transmitting information that shows the reflective surface that the specifying unit specified to the image processing unit will be needed, which increases cost of an image forming apparatus.

SUMMARY OF THE INVENTION

The present invention provides an information processing apparatus and an image forming apparatus connected thereto that are capable of specifying a reflection surface cheaply and accurately.

Accordingly, a first aspect of the present invention provides an information processing apparatus connected with an image forming apparatus including an image forming unit. The image forming unit includes a first reception unit configured to receive image data, a light source configured to emit light according to the image data received by the first reception unit, a photosensitive member, a polygon mirror that has a plurality of reflection surfaces and deflects the light emitted from the light source by using the plurality of reflection surfaces to scan the photosensitive member by rotating, a light receiving unit configured to have a light receiving element that receives the light deflected by the polygon mirror, a specifying unit configured to specify a reflection surface used for scanning the photosensitive member among the plurality of reflection surfaces, a generation unit configured to generate a signal having a first level and a second level based on information about the reflection surfaces specified by the specifying unit, a period of the first level of the signal corresponding to a predetermined reflection surface among the plurality of reflection surfaces being longer than a period of the first level of the signal corresponding to the other reflection surfaces than the predetermined reflection surface. The information processing apparatus includes a second reception unit configured to receive the signal, a detection unit configured to detect a first timing at which the signal changes to the first level from the second level and a second timing at which the signal changes to the second level from the first level, a measurement unit configured to measure a period from the first timing detected by the detection unit to the second timing that is detected first after elapsing a first period from the first timing, an update unit configured to specify the reflection surface based on the period measured by the measurement unit and to update surface information about the reflection surfaces every time of receiving the signal after specifying the reflection surfaces, a storage unit configured to store a plurality of pieces of correction data that respectively correspond to a different one of the plurality of reflection surfaces in association with the surface information, a correction unit configured to correct the image data corresponding to the reflection surface according to the surface information and the correction data stored in the storage unit, and an output unit configured to output the image data corrected by the correction unit to the image forming unit in response to detection of the first timing. The first period is shorter than a period from the first timing to the second timing corresponding to the predetermined reflection surface and is longer than a period from the first timing to the second timing corresponding to the other reflection surfaces.

Accordingly, a second aspect of the present invention provides an image forming apparatus including the first reception unit, the light source, the photosensitive member, the polygon mirror, the light receiving unit, the specifying unit, the generation unit, the second reception unit, the detection unit, the measurement unit, the update unit, the storage unit, the correction unit, and the output unit that are common to the first aspect.

According to the present invention, a reflective surface can be specified cheaply and accurately.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

However, shapes of components and relative arrangements thereof described in the embodiments should be changed suitably according to a configuration of an apparatus to which the present invention is applied and various conditions. The scope of the present invention is not limited to the following embodiments.

Figure 1:
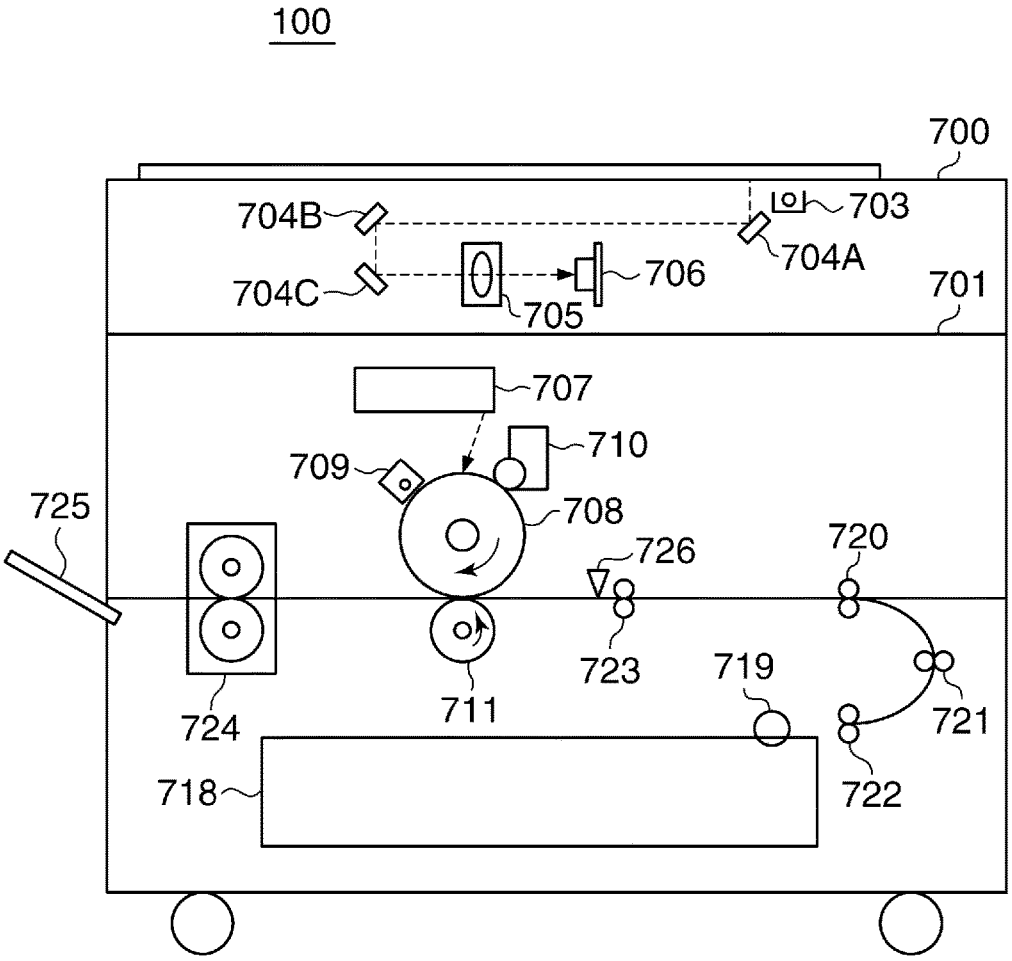
FIG. 1 is a sectional view showing a configuration of an image forming apparatus.

FIG. 1 is a sectional view showing a configuration of an image forming apparatus including an information processing apparatus according to an embodiment of the present invention. This image forming apparatus 100 is constituted as a monochrome copying machine with an electrophotographic system as an example. It should be noted that the image forming apparatus 100 may not be limited to a copying machine but may be a facsimile machine, a printing machine, a printer, etc. Moreover, the image forming apparatus 100 may be a color copying machine.

Hereinafter, a configuration and function of the image forming apparatus 100 will be described with reference to FIG. 1. As shown in FIG. 1, the image forming apparatus 100 has an image reading device (hereinafter referred to as a reader) 700 and an image printing device 701.

Reflected light from an original with that is irradiated with the illumination lamp 703 at a reading position of the reader 700 is guided to a color sensor 706 through an optical system that consists of reflective mirrors 704A, 704B, and 704C and a lens 705. The reader 700 reads the light that is incident on the color sensor 706 for each of colors of blue (called B), green (called G), and red (called R) and converts them into electric image signals. Furthermore, the reader 700 obtains image data for printing by performing a color conversion process on the basis of intensities of the image signals of B, G, and R. Then, the reader 700 outputs the image data to an image controller 1007 (see FIG. 3) as an information processing apparatus mentioned later.

As shown in FIG. 1, a sheet storing tray 718 is provided inside the image printing device 701. A recording medium stored in the sheet storing tray 718 is fed by a feed roller 719 and is sent to a registration roller pair 723 in a stopped state by conveying roller pairs 722, 721, and 720. The front end of the recording medium conveyed by the conveying roller pair 720 in a conveyance direction is abutted to a nip portion of the registration roller pair 723 in the stopped state. Then, when the conveying roller pair 720 further conveys the recording medium in a state where the front end of the recording medium is abutting to the nip portion of the registration roller pair 723 in the stopped state, the recording medium bends. As a result, elastic force is exerted to the recording medium and the front end of the recording medium abuts along with the nip portion of the registration roller pair 723. This corrects skew of the recording medium. The registration roller pair 723 starts conveyance of the recording medium at a below-mentioned timing after correcting the skew of the recording medium. It should be noted that the recording medium on which an image is formed by the image forming apparatus may be a paper sheet, a resin sheet, cloth, an OHP sheet, or a label.

The image data obtained by the reader 700 is corrected by the image controller 1007 (FIG. 3) and is inputted into a laser scanner unit 707 including a laser and a polygon mirror. Moreover, an electrostatic charger 709 charges an outer circumferential surface of a photosensitive drum 708. After the outer circumferential surface of the photosensitive drum 708 is charged, the outer circumferential surface of the photosensitive drum 708 is irradiated with the laser beam corresponding to the image data inputted into the laser scanner unit 707 from the laser scanner unit 707. As a result, an electrostatic latent image is formed on a photosensitive layer (photosensitive member) that covers the outer circumferential surface of the photosensitive drum 708. It should be noted that a method for forming the electrostatic latent image on the photosensitive layer by the laser beam will be mentioned later.

Next, the electrostatic latent image is developed by toner in a development device 710, and a toner image is formed on the outer circumferential surface of the photosensitive drum 708. The toner image formed on the photosensitive drum 708 is transferred to the recording medium by a transferring charging unit 711 provided at a position (transfer position) that faces the photosensitive drum 708. It should be noted that the registration roller pair 723 sends the recording medium into the transfer position at a timing that the toner image is transferred to a predetermined position of the recording medium.

The recording medium to which the toner image is transferred is sent into a fixing device 724. The fixing device 724 heats and presses the recording medium to fix the toner image. The recording medium to which the toner image is fixed is ejected to a discharge tray 725 outside the apparatus.

Thus, the image is formed on the recording medium by the image forming apparatus 100. The above is description about the configuration and functions of the image forming apparatus 100.

Figure 2:
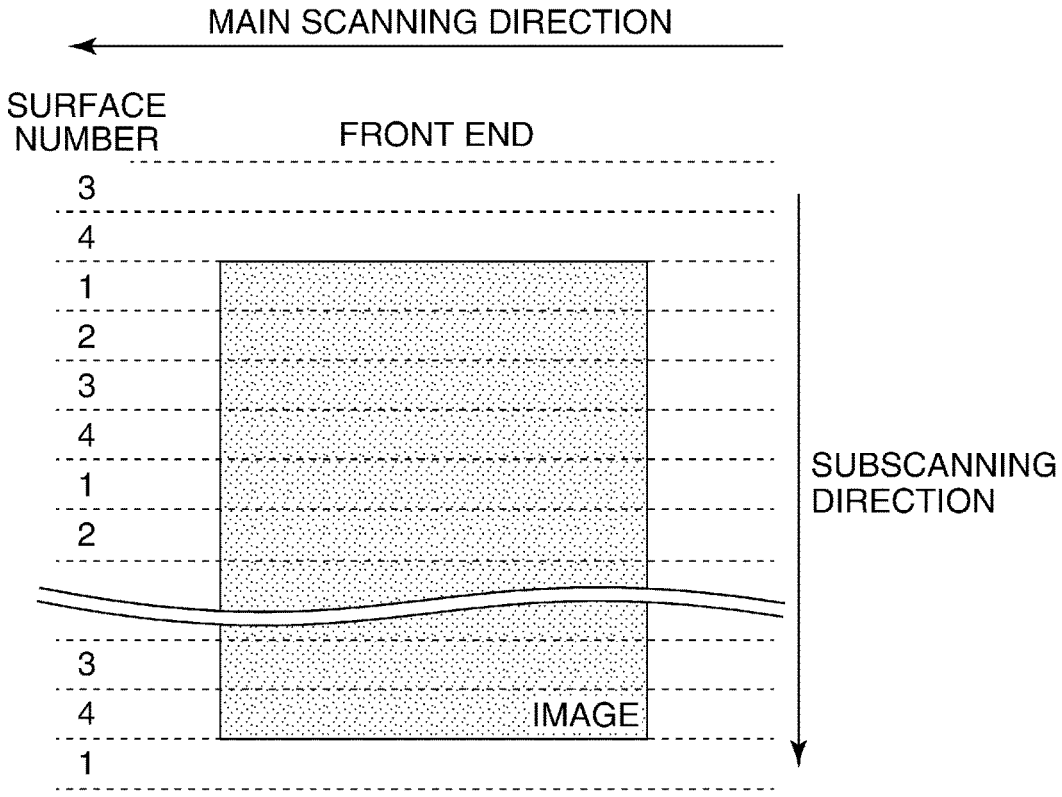
FIG. 2 is a view showing an example of the read image data.

As shown in FIG. 2, when the laser beam deflected by one reflection surface among the plurality of reflection surfaces of a polygon mirror 1002 scans a photosensitive layer in an axial direction (main scanning direction) of the photosensitive drum 708, an image (electrostatic latent image) for one scan (one line) is formed on the photosensitive layer. The electrostatic latent image for one page of a recording medium is formed by repeatedly scanning the photosensitive layer with the laser beam deflected by the respective surfaces in the rotational direction (subscanning direction) of the photosensitive drum 708. In the following description, the image data corresponding to the electrostatic latent image for one line is called image data.

Figure 3:
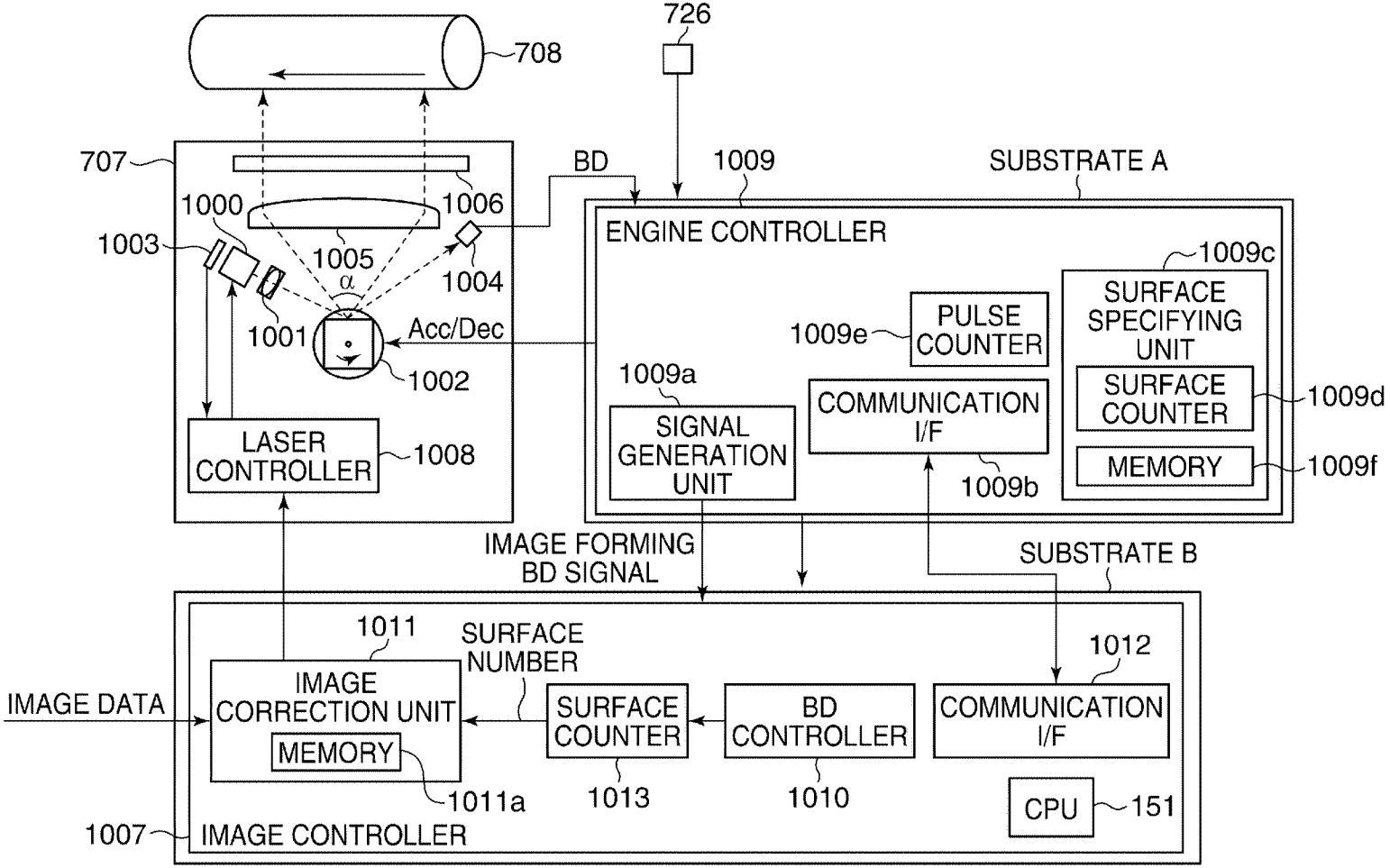
FIG. 3 is a block diagram showing a configuration of a laser scanner unit.

FIG. 3 is a block diagram showing a configuration of the laser scanner unit 707 in this embodiment. Hereinafter, the configuration of the laser scanner unit 707 will be described. It should be noted that a substrate A in which an engine controller 1009 is provided is different from a substrate B in which the image controller 1007 is provided in this embodiment as shown in FIG. 3. Moreover, the substrate A in which the engine controller 1009 is provided is connected to the substrate B in which the image controller 1007 is provided through a cable (not shown).

As shown in FIG. 3, the laser beam is emitted from both ends of a laser light source 1000 as an emission unit. The laser beam emitted from one end of the laser light source 1000 enters into a photodiode (PD) 1003. The photodiode 1003 converts the incident laser beam into an electrical signal and outputs it to a laser controller 1008 as a PD signal. The laser controller 1008 controls an output light amount of the laser light source 1000 on the basis of the input PD signal so that the output light amount of the laser light source 1000 becomes a predetermined light amount (Auto Power Control, hereinafter referred to as APC).

In the meantime, the laser beam emitted from the other end of the laser light source 1000 irradiates the polygon mirror 1002 as a rotational polygon mirror through a collimator lens 1001. The polygon mirror 1002 is rotated counterclockwise by a polygon motor (not shown). The polygon motor is controlled by a driving signal (Acc/Dec) output from the engine controller 1009. Although the polygon mirror 1002 shall be rotated counterclockwise in this embodiment, the polygon mirror 1002 may be rotated clockwise.

The laser beam that irradiates the rotating polygon mirror 1002 is deflected by the polygon mirror 1002. The laser beam deflected by the polygon mirror 1002 scans the outer circumferential surface of the photosensitive drum 708 in the direction from the right toward the left in FIG. 3. The laser beam that scans the outer circumferential surface of the photosensitive drum 708 is corrected by an f-θ lens 1005 so as to scan the outer circumferential surface of the photosensitive drum 708 at uniform velocity, and irradiates the outer circumferential surface of the photosensitive drum 708 through a folding mirror 1006.

Moreover, the laser beam deflected by the polygon mirror 1002 enters into a BD (Beam Detect) sensor 1004 as a light receiving unit equipped with a light receiving element that receives the laser beam concerned. In this embodiment, the BD sensor 1004 is arranged at a position where the laser beam irradiates the outer circumferential surface of the photosensitive drum 708 after the BD sensor 1004 detects the laser beam within a period between adjacent timings at which the BD sensor 1004 detects the laser beam. Specifically, the BD sensor 1004 is arranged at an upstream outside of an area shown by an angle α in the scanning direction of the laser beam within an area where the laser beam reflected by the polygon mirror 1002 passes, for example, as shown in FIG. 3.

The BD sensor 1004 generates an original BD signal (first signal) as a synchronizing signal on the basis of the detected laser beam and outputs it to the engine controller 1009. The engine controller 1009 controls the polygon motor on the basis of the input original BD signal so that the rotation cycle of the polygon mirror 1002 becomes a predetermined cycle. When the cycle of the original BD signal becomes the cycle corresponding to the predetermined cycle, the engine controller 1009 determines that the rotation cycle of the polygon mirror 1002 becomes the predetermined cycle.

As shown in FIG. 3, a detection result of a sheet sensor 726 that is arranged at the downstream side of the registration roller pair 723 and detects arrival of the front end of the recording medium in the conveyance direction of the recording medium is input into the engine controller 1009.

The engine controller 1009 has a signal generation unit 1009*a* that generates an image forming BD signal (second signal) output to the image controller 1007 on the basis of the original BD signal input from the BD sensor 1004. When the sheet sensor 726 detects the front end of the recording medium, the signal generation unit 1009*a* as a generation unit outputs the image forming BD signal to the image controller 1007. The image forming BD signal is synchronized with the original BD signal. It should be noted that the image forming BD signal shows one scanning cycle that the laser beam scans the photosensitive drum 708. The signal generation unit 1009*a* generates and outputs the image forming BD signal in response to reception of the laser beam by the BD sensor 1004.

The image controller 1007 outputs the corrected image data to the laser controller 1008 as a first reception unit in response to the input image forming BD signal. A concrete control configuration of the engine controller 1009 and the image controller 1007 will be mentioned later.

The laser controller 1008 generates the laser beam for forming an image on the outer circumferential surface of the photosensitive drum 708 by emitting the laser light source 1000 on the basis of the input image data. Thus, the laser controller 1008 is controlled by the image controller 1007 as the information processing apparatus. The generated laser beam irradiates the outer circumferential surface of the photosensitive drum 708 by the method mentioned above.

Distance (first distance) from the position at which the sheet sensor 726 detects the recording medium to the transfer position is longer than distance (second distance) from the position on the outer circumferential surface of the photosensitive drum 708 to which the laser beam irradiates to the transfer position in the rotational direction of the photosensitive drum 708. Specifically, the first distance is calculated by adding the second distance to the distance along which the recording medium is conveyed during a period from a timing at which the sheet sensor 726 detects the front end of the recording medium to a timing at which the laser light source 1000 emits the laser beam. In a period from a timing at which the sheet sensor 726 detects the front end of the recording medium to a timing at which the laser light source 1000 emits the laser beam, the image controller 1007 corrects the image data and controls the laser controller 1008. The above is description about the configuration of the laser scanner unit 707.

The image controller 1007 outputs the corrected image data to the laser controller 1008 sequentially from the image data of the uppermost line in the subscanning direction according to the cycle of the input image forming BD signal. The laser controller 1008 forms an image on the outer circumferential surface of the photosensitive drum 708 by controlling the laser light source 1000 in response to the input image data. Although the polygon mirror 1002 has four reflection surfaces in this embodiment, the number of the reflection surfaces of the polygon mirror 1002 is not limited to four.

The image formed on the recording medium is formed by the laser beam deflected by the plurality of reflection surfaces of the polygon mirror 1002. Specifically, as shown in FIG. 2, the image corresponding to the image data of the uppermost line in the subscanning direction is formed by the laser beam deflected by the first surface of the polygon mirror 1002, for example. Moreover, the image corresponding to the second image data from the uppermost line in the subscanning direction is formed by the laser beam deflected by the second surface that is different from the first surface of the polygon mirror 1002. Thus, the image formed on the recording medium consists of images formed by the laser beam reflected by the different reflection surfaces among the plurality of reflection surfaces of the polygon mirror 1002.

When the polygon mirror that has four reflection surfaces is used, an angle that is formed by adjacent two reflection surfaces may not be 90 degrees for certain. Specifically, when the polygon mirror that has four reflection surfaces is viewed in a rotation axis direction, the angle that is formed by adjacent two sides may not be 90 degrees for certain (i.e., the shape of the polygon mirror viewed in the rotation axis direction is not a square). When a polygon mirror that has n-pieces (n is a positive integer) of reflection surfaces is used, the shape of the polygon mirror viewed in the rotation axis direction may not be a regular n-polygon.

When an angle that is formed by adjacent two reflection surfaces of a polygon mirror having four reflection surfaces is not 90 degrees for certain, a position and a size of an image differs for every reflection surface. As a result, distortion occurs in an image formed on the outer circumferential surface of the photosensitive drum 708, which causes distortion in an image formed on the recording medium.

Consequently, the image data is corrected with a correction amount (correction data) corresponding to each of the plurality of reflection surfaces of the polygon mirror 1002 (i.e., corrects a writing start position, etc.) in this embodiment. This case needs to specify a surface that deflects the laser beam. Hereinafter, an example of a method for specifying a surface that deflects the laser beam will be described. In this embodiment, a surface specifying unit 1009*c* provided in the engine controller 1009 specifies a surface that deflects (reflects) the laser beam among the plurality of reflection surfaces of the polygon mirror 1002.

Figure 4A:
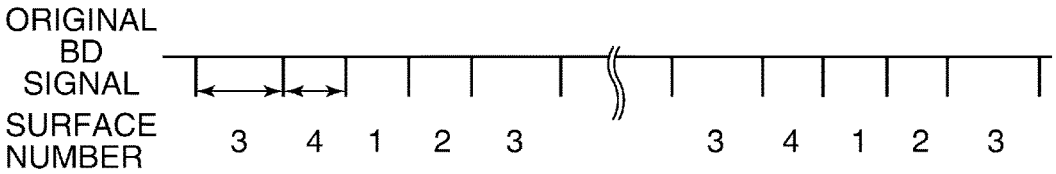
FIG. 4A and FIG. 4B are views showing examples of a relation between an original BD signal and the number of surface (surface number) that deflects a laser beam.

FIG. 4A is a view showing an example of the relation between the original BD signal generated when the laser beam scans a light receiving surface of the BD sensor 1004 and the surface (surface number) that deflects the laser beam. As shown in FIG. 4A, a cycle (scanning cycle) in which the laser beam scans the light receiving surface of the BD sensor 1004 differs for every surface of the polygon mirror 1002.

In FIG. 4A, the cycle T1 corresponds to the surface number "1", the cycle T2 corresponds to the surface number "2", the cycle T3 corresponds to the surface number "3", and the cycle T4 corresponds to the surface number "4". The respective cycles are stored in a memory 1009*f* provided in the surface specifying unit 1009*c*.

Figure 4B:
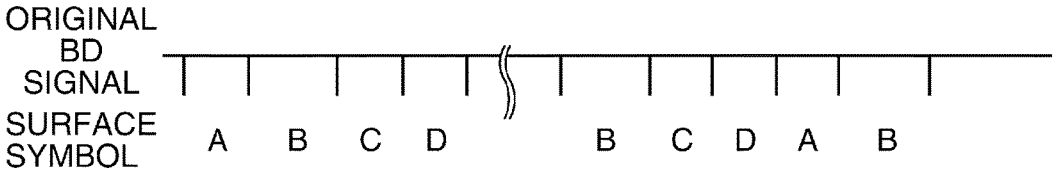

The surface specifying unit 1009*c* specifies the surface (surface number) that deflects the laser beam by the following method. Specifically, the surface specifying unit 1009*c* respectively allocates surface symbols A to D to the continuous four scanning cycles of the original BD signal as shown in FIG. 4B. Then, the surface specifying unit 1009*c* measures the scanning cycle at a plurality of times (for example, 32 times) for each of the surface symbols A to D and calculates an average of the measured scanning cycle for each of the surface symbols A to D.

The engine controller 1009 associates the surface symbols A to D to the surface numbers "1" to "4" on the basis of the calculated averages and the cycles T1 to T4 stored in the memory 1009*f*.

As mentioned above, the surface specifying unit 1009*c* specifies the number of the surface (the reflection surface used for scanning the photosensitive drum 798 among the plurality of reflection surfaces of the polygon mirror 1002) that deflects the laser beam on the basis of the original BD signal input.

Next, control performed by the engine controller 1009 in this embodiment will be described with reference to FIG. 3 and FIG. 5. As shown in FIG. 3, the surface specifying unit 1009*c* has a surface counter 1009*d* that stores surface information showing the reflection surface that deflects the laser beam that scans the light receiving surface of the BD sensor 1004 among the plurality of reflection surfaces.

Figure 5:
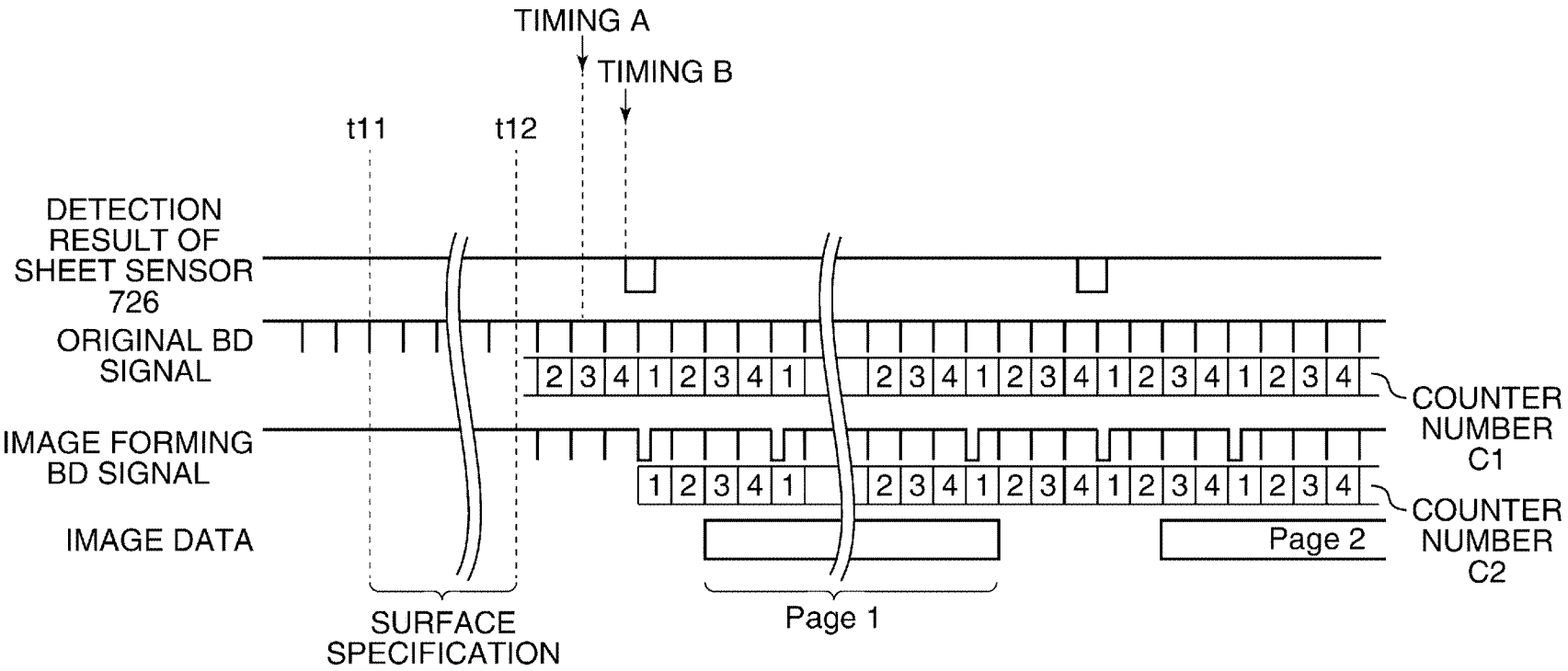
FIG. 5 is a view showing an example of various signals and the count number (surface number) of a surface counter.

FIG. 5 is a view showing an example of various signals and the count number C1 (surface number) of the surface counter 1009*d*. It should be noted that the count number C1 of the surface counter 1009*d* corresponds to the surface information. When the rotation cycle of the polygon mirror 1002 becomes a predetermined cycle at a timing t11, the engine controller 1009 (surface specifying unit 1009*c*) specifies (determines) the surface number by the method mentioned above on the basis of the original BD signal input.

The engine controller 1009 starts counting with the surface counter 1009*c* from a timing t12 at which the surface specifying unit 1009*c* completes specification (presumption) of the surface number. Specifically, when the specification of the surface number (surface specification) is completed, the engine controller 1009 sets up the surface number shown by the original BD signal input first after completing the specification of the surface number as an initial value of the count number C1 of the surface counter 1009*d*. After setting up the initial value of the count number C1, the engine controller 1009 updates the count number C1, whenever a falling edge of the original BD signal input is detected, for example. It should be noted that the count number C1 is a positive integer that satisfies $1 \leq C1 \leq 4$.

The engine controller 1009 (signal generation unit 1009*a*) starts outputting an image forming BD signal, when the surface specification is completed. Moreover, the engine controller 1009 notifies the image controller 1007 that the surface specification has been completed through a communication I/F 1009*b*.

The signal generation unit 1009*a* notifies the image controller 1007 of the surface number by changing the effective duration of the BD signal corresponding to a predetermined reflection surface and outputting it as the image forming BD signal. In the description, the image forming BD signal is constituted by a first level and a second level. Although the first level is a Low level and the second level is a High level in this embodiment, the relations may be inverted. A BD cycle BDC matches a period between adjacent falling edges to the first level of the image forming BD signal. The effective duration is a period during which the image forming BD signal holds the first level. Strictly, the effective duration is a period after the image forming BD signal falls to the first level until it rises to the second level. The signal generation unit 1009*a* generates the image forming BD signal so that the duration of the Low level of the image forming BD signal corresponding to the surface number "1" becomes longer than the duration of the Low level corresponding to the other surface numbers "2", "3", and "4", and outputs it to the image controller 1007. It is not indispensable to make the effective duration corresponding to a predetermined reflection surface be longer than the effective duration corresponding to the other reflection surfaces. The former effective duration may be shorter than the later effective duration. Namely, the effective duration corresponding to the predetermined reflection surface has only to differ from the effective duration corresponding to the other reflection surfaces. Since the engine controller 1009 is able to notify the image controller 1007 of the information about the reflection surfaces using the signal line for sending the image forming BD signal without newly providing an exclusive signal line, the image controller 1007 is able to specify a reflection surface with an inexpensive configuration.

The CPU 151 of the image controller 1007 controls the engine controller 1009 through a communication I/F 1012 so as to execute printing (forming an image on a recording medium) when the CPU 151 is notified of the completion of the surface specification by the engine controller 1009 (timing A). Accordingly, the engine controller 1009 starts driving the registration roller pair 723. As a result, the front end of the recording medium is detected by the sheet sensor 726 (timing B).

When the sheet sensor 726 detects the front end of the recording medium, the engine controller 1009 counts the number of pulses of the output image forming BD signal using a pulse counter 1009*e*. When the count value of the pulse counter 1009*e* reaches the number of pulses corresponding to one page of the recording medium, the engine controller 1009 stops driving the registration roller pair 723. Moreover, when the sheet sensor 726 detects the front end of the recording medium, the engine controller 1009 outputs a signal (an image request signal) to request image data from the image controller 1007.

Figure 6:
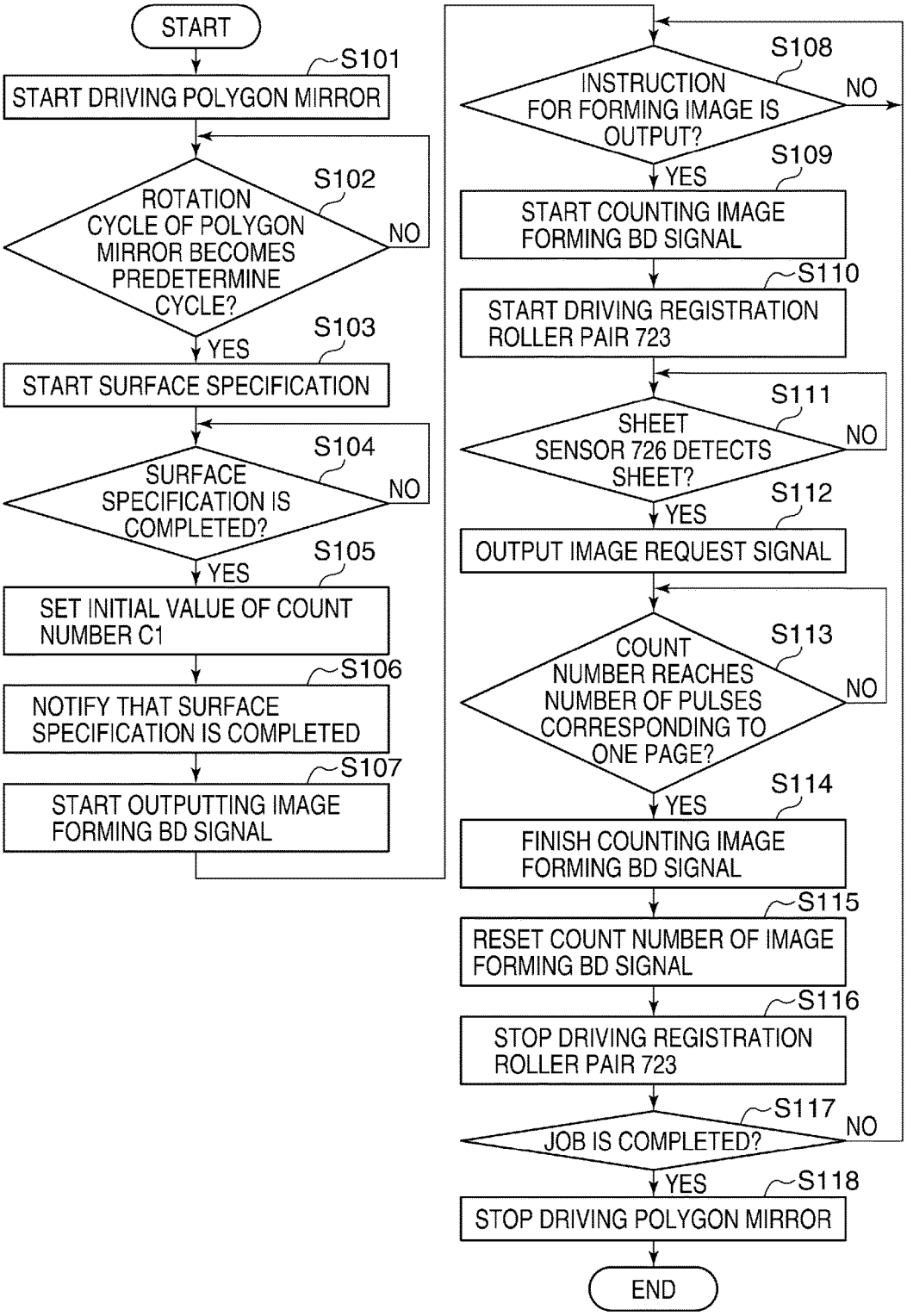
FIG. 6 is a flowchart describing control that an engine controller executes.

FIG. 6 is a flowchart describing the control that is executed by the engine controller 1009 of the embodiment. The process of the flowchart shown in FIG. 6 is executed by the engine controller 1009. In the following description, the engine controller 1009 updates the count number C1 every time when a falling edge of the original BD signal input is detected after the surface specification is completed.

First, the engine controller 1009 starts driving the polygon mirror 1002 (step S101), and waits until the rotation cycle of the polygon mirror 1002 becomes the predetermined cycle (step S102). When the rotation cycle of the polygon mirror 1002 becomes the predetermined cycle, the engine controller 1009 (surface specifying unit 1009*c*) starts specifying the surface (surface number) on the basis of the original BD signal input. Then, the engine controller 1009 waits until the surface specification is completed (step S104). Then, when the surface specification is completed, the engine controller 1009 sets up the surface number shown by the original BD signal input first after completing the specification of the surface number as an initial value of the count number C1 of the surface counter 1009*d* (step S105).

Next, the engine controller 1009 notifies the image controller 1007 that the surface specification has been completed through the communication I/F 1009*b* (step S106). Then, the engine controller 1009 (signal generation unit 1009*a*) starts the process for changing the effective duration of the BD signal corresponding to a predetermined reflection surface and outputting it as the image forming BD signal to the image controller 1007 (step S107). Next, the engine controller 1009 waits until an instruction for forming an image on the recording medium is output (step S108). When the instruction for forming an image on the recording medium is output, the engine controller 1009 starts counting the number of pulses of the image forming BD signal with the pulse counter 1009*e* (step S109). Furthermore, the engine controller 1009 starts driving the registration roller pair 723 (step S110). Next, the engine controller 1009 waits until the sheet sensor 726 detects the front end of the recording medium (step S111). When the sheet sensor 726 detects the front end of the recording medium, the engine controller 1009 outputs a signal (image request signal) that requests image data from the image controller 1007 (step S112). Next, the engine controller 1009 waits until the count number of the pulse counter 1009*e* reaches the number of pulses corresponding to one page of the recording medium (step S113). Then, when the count number reaches the number of pulses corresponding to one page of the recording medium, the engine controller 1009 finishes counting with the pulse counter 1009*e* (step S114) and resets the count number of the pulse counter 1009*e* (step S115).

Then, the engine controller 1009 determines whether the job has been completed (step S117). When the job has not been completed, the engine controller 1009 returns the process to the step S108. In the meantime, when the job has been completed, the engine controller 1009 stops driving the polygon mirror 1002 (step S118) and finishes the process in FIG. 6.

The above is description about the control that the engine controller 1009 performs.

Next, control that the image controller 1007 performs will be described. As shown in FIG. 3, the image controller 1007 has a BD controller 1010 as a second reception unit that receives the image forming BD signal. Moreover, the image controller 1007 has a surface counter 1013 that stores the surface information showing the reflection surface that deflects the laser beam that scans the light receiving surface of the BD sensor 1004 among the plurality of reflection surfaces on the basis of the image forming BD signal detected by the BD controller 1010.

Figure 7:
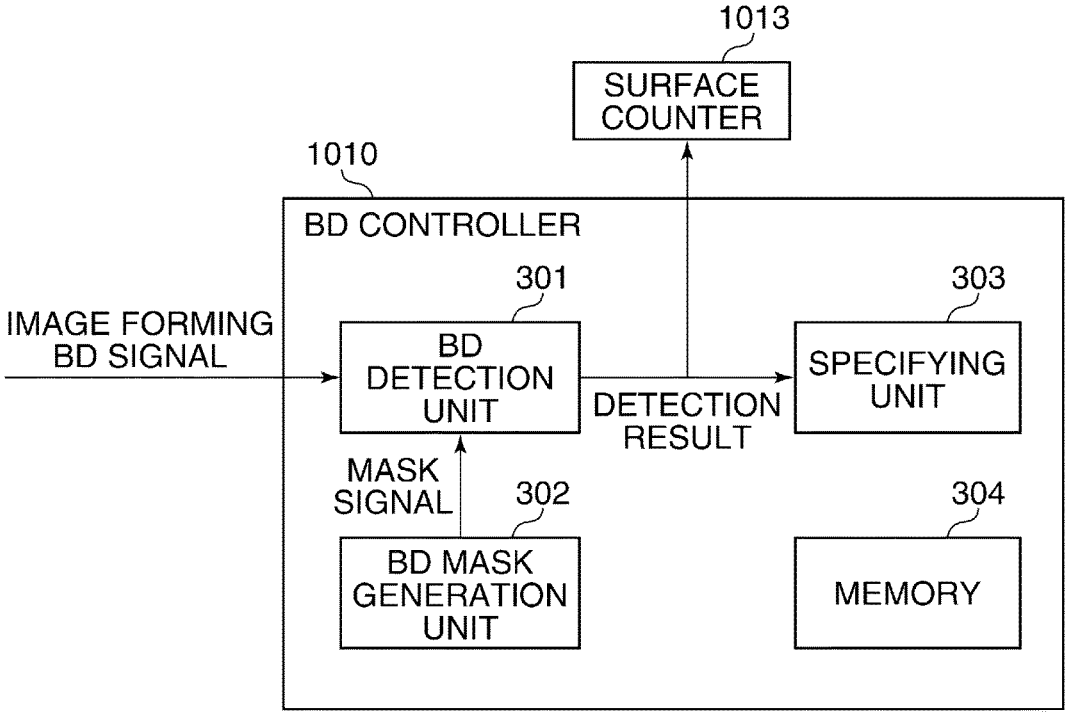
FIG. 7 is a block diagram showing a BD controller.

FIG. 7 is a block diagram showing the BD controller 1010. The BD controller 1010 has a BD detection unit (detection unit) 301, a specifying unit 303, and a BD mask generation unit 302 as a generation unit that generates a mask signal for obstructing detection of the image forming BD signal in a certain fixed period.

The BD detection unit 301 detects a falling edge and a rising edge of the input image forming BD signal and outputs a detection result to the surface counter 1013 and the specifying unit 303. The specifying unit 303 measures a period from a timing at which the BD detection unit 301 detects the falling edge of the image forming BD signal to a timing at which the rising edge is detected. The specifying unit 303 specifies the surface number that is shown by the image forming BD signal input into the image controller 1007 on the basis of the measuring result concerned. Specifically, the specifying unit 303 specifies that the surface number that the input image forming BD signal shows is "1", when the measuring result is larger than a predetermined value (predetermined period). It should be noted that the predetermined value is smaller than duration (effective duration A) of the first level of the image forming BD signal corresponding to the predetermined reflection surface and is larger than duration (effective duration B) of the first level of the image forming BD signal corresponding to the reflection surfaces other than the predetermined reflection surface (A>B, in this example). The effective durations A and B described with reference to FIG. 8A and FIG. 8B are beforehand stored in the memory 304 of the BD controller 1010, for example.

When the specifying unit 303 specifies that the surface number that the input image forming BD signal shows is "1", the CPU 151 sets up an initial value of a count number C2 of the surface counter 1013 to "1". After setting up the initial value, the surface counter 1013 updates the count number C2 every time when the BD detection unit 301 detects a falling edge of the image forming BD signal.

When noise mixes with the image forming BD signal output to the image controller 1007 from the engine controller 1009, there is a possibility that each reflection surface cannot be specified correctly because the image controller 1007 cannot measure an effective duration correctly. Accordingly, in the embodiment, a reflection surface is specified with high accuracy by applying the following configuration.

Figure 8A:
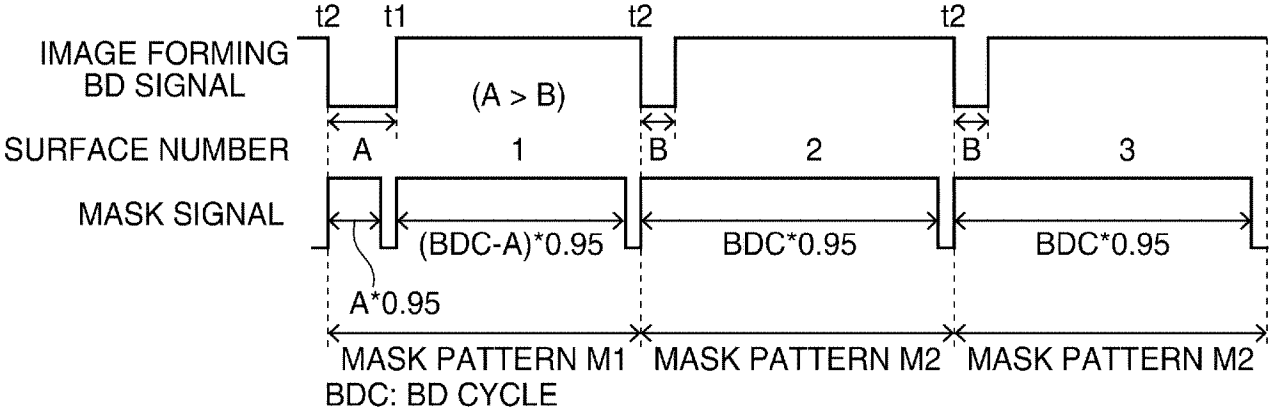
FIG. 8A and FIG. 8B are views showing examples of an image forming BD signal and a mask pattern.
Figure 8B:
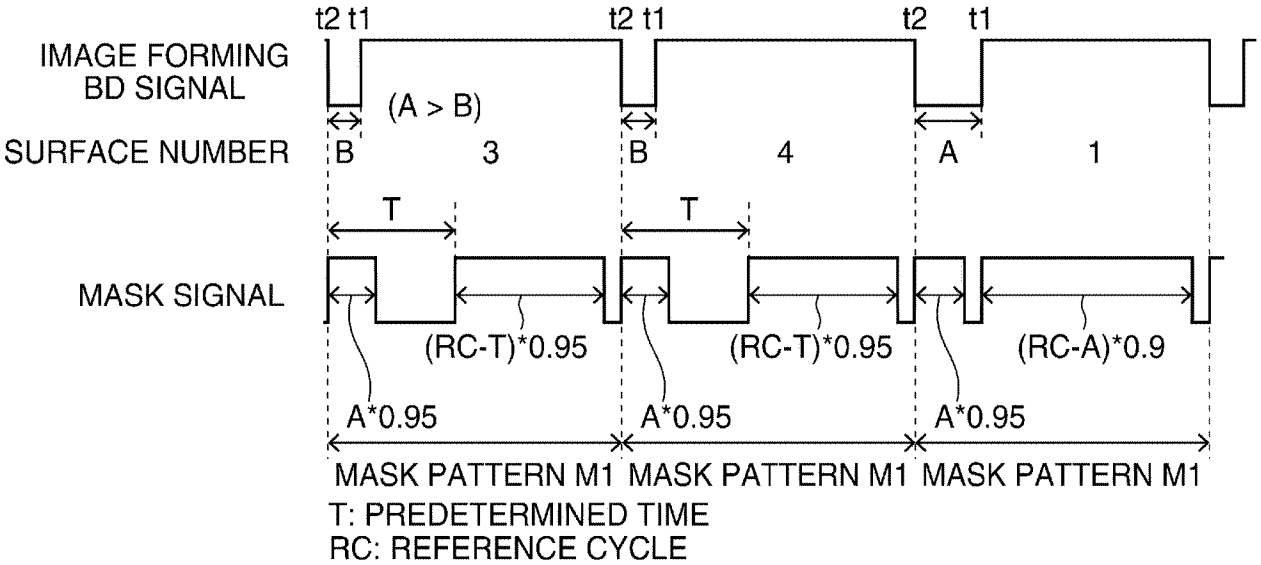

FIG. 8A and FIG. 8B are views showing examples of the image forming BD signal and a mask signal (BD mask). In this embodiment, the BD detection unit 301 does not detect a falling edge and rising edge of the image forming BD signal in a period during which the mask signal is "H", but detects a falling edge and rising edge of the image forming BD signal in a period during which the mask signal is "L". However, the aspect of the disclosure is not limited to the above configuration. For example, the mask signal may be input to the specifying unit 303. In such a case, the following configuration may be employed. That is, the specifying unit 303 does not reflect the detection result of the BD detection unit 301 to the specification of a reflection surface in a period during which the mask signal is "H", but reflects the detection result of the BD detection unit 301 to the specification of a reflection surface in a period during which the mask signal is "L". As shown in FIG. 8A and FIG. 8B, the image forming BD signal corresponding to each reflection surface shall be switched to the first level from the second level at a switching timing (first timing) t2. Moreover, the image forming BD signal corresponding to each reflection surface shall be switched to the second level from the first level at a switching timing (second timing) t1.

In a mask pattern M1, the mask signal of "H" is output in a period that is 95% of the effective duration A (duration shorter than the effective duration A (A*0.95)) (a first predetermined period) from the switching timing t2 as a starting point. Moreover, the mask signal of "H" is output in a period that is shorter than a value obtained by subtracting the effective duration A from a reference cycle RC ((RC−A)*0.95) (a second predetermined period) from the switching timing t1 as a starting point. As shown in FIG. 8B, when a rising edge of the image forming BD signal is not detected even if a predetermined period T elapses after the first predetermined period elapsed from the switching timing t2, the mask signal of "H" is output in a period that is shorter than a value obtained by subtracting the predetermined period T from the reference cycle RC ((RC−T)*0.95) (a third predetermined period) from the timing at which the first predetermined period concerned elapsed as a starting point. The reference cycle RC is set to the shortest BD cycle among the BD cycles corresponding to the plurality of reflection surfaces of the polygon mirror.

In the meantime, in a mask pattern M2, the mask signal of "H" is output in a period that is shorter than the reference cycle RC (RC*0.95) (a fourth predetermined period) from the switching timing t2 as a starting point. The value of 95% used for setting the period during which the mask signal of "H" is output is an example, and the value has only to be smaller than 100%.

In this embodiment, the mask pattern M1 is applied to the detection by the BD detection unit 301 until a predetermined reflection surface is specified. Moreover, after the predetermined reflection surface is specified, the mask pattern M2 is applied to the detection by the BD detection unit 301. It should be noted that the mask patterns are switched by the CPU 151, for example.

Figure 9:
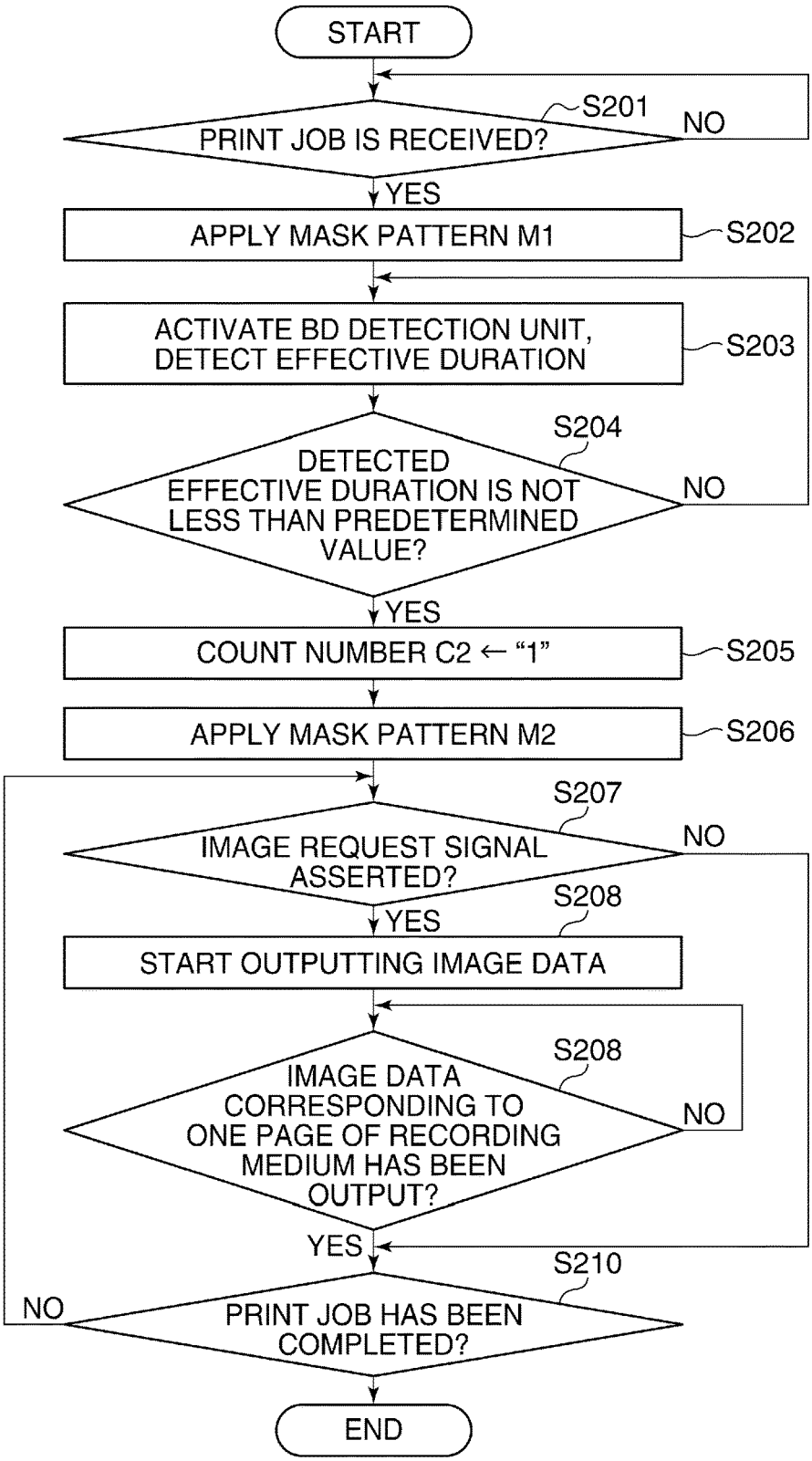
FIG. 9 is a flowchart of a job process.

FIG. 9 is a flowchart of a job process in this embodiment. This process is executed by the CPU 151. This process is achieved when the CPU 151 reads a program stored in a storage unit (not shown) to a RAM (not shown) and runs it.

First, the CPU 151 waits until a print job is received (step S201). When the print job is received, the CPU 151 controls the BD mask generation unit 302 and BD detection unit 301 and applies the mask pattern M1 to the BD detection unit 301 (step S202). Then, the CPU 151 activates the BD detection unit 301 so as to obtain the image forming BD signal and detects the effective duration by controlling the specifying unit 303 (step S203). The effective duration is a period from a falling edge to a rising edge of the image forming BD signal. Next, the CPU 151 obtains the measured period as a "detected effective duration".

When the current reflection surface is the predetermined reflection surface during the mask pattern M1 is applied, since the timing t1 comes within the period during which the mask pattern M1 does not obstruct the detection of the image forming BD signal, the detected effective duration (=A) is obtained. In the meantime, when the current reflection surface is not the predetermined reflection surface, the timing t1 may not come within the period during which the mask pattern M1 does not obstruct the detection. Accordingly, when the rising edge (t1) is not detected until the period corresponding to the effective duration A elapses from the falling edge (t2) of the image forming BD signal, the CPU 151 obtains a fixed value (for example, "0") different from the effective duration A as a detected effective duration, for example.

Next, the CPU 151 determines whether the detected effective duration is not less than a predetermined value (step S204). As a result of the determination in the step S204, when the detected effective duration is not less than the predetermined value, the CPU 151 determines that the current reflection surface is the predetermined reflection surface and sets the count number C2 of the surface counter 1013 to "1" as an initial value (step S205). Then, the CPU 151 applies the mask pattern M2 generated by the BD mask generation unit 302 to the BD detection unit 301 from the next falling edge (t2) of the image forming BD signal as a starting point (step S206) and proceeds with the process to step S207. In the meantime, when the detected effective duration is less than the predetermined value, the CPU 151 returns the process to the S203 and measures a period again.

In the step S207, the CPU 151 determines whether the image request signal has been input into the image controller 1007 from the engine controller 1009 (i.e., whether the image request signal asserted). Then, when the image request signal has not been input, the CPU 151 proceeds with the process to step S210. In the meantime, when the image request signal has been input, the CPU 151 starts outputting image data in synchronization with the image forming BD signal (step S208). When the image data is output here, the CPU 151 corrects magnification and a writing start position of an image according to previously measured characteristics of each of the reflection surfaces that are already specified. It should be noted that there is no limitation about contents of the correction. Then, the process proceeds to step S209.

Incidentally, the image correction unit 1011 has a memory (storage unit) 1011*a*. A plurality of correction data that respectively correspond to the plurality of reflection surfaces are stored in the memory 1011*a* in association with the surface information. The image correction unit 1011 as a correction unit corrects image data corresponding to each of the reflection surfaces on the basis of the surface information and the correction data. The image correction unit 1011 as a second output unit outputs the corrected image data to the laser scanner unit 707 in response to the image forming BD signal received by the BD controller 1010. After that, the CPU 151 determines whether the image data corresponding to one page of the recording medium has been output (step S209). When the image data corresponding to one page of the recording medium has been output, the CPU 151 proceeds with the process to step S210.

In the step S210, the CPU 151 determines whether the print job has been completed. Then, the CPU 151 returns the process to the step S207 when the print job has not been completed and finishes the process in FIG. 9 when the print job has been completed.

According to the process in FIG. 9, the CPU 151 applies the mask pattern M1 until the predetermined reflection surface is specified to reduce mixing of noise while securing the measurement of the effective duration. Then, the CPU 151 applies the mask pattern M2 after the predetermined reflection surface is specified. Thereby, the misdetection due to mixing of noise is prevented effectively while securing the measurement of the effective duration and the detection of the BD cycle.

The mask pattern M1 is applied until the predetermined reflection surface is specified and the mask pattern M2 is applied after the predetermined reflection surface is specified in this embodiment. However, the aspect of the disclosure is not limited to the above configuration. For example, the mask pattern M1 may be applied even after the predetermined reflection surface is specified. It should be noted that the surface counter 1013 updates the count number C2 every time when the BD detection unit 301 detects a falling edge of the image forming BD signal after specifying the predetermined reflection surface.

Figure 10:
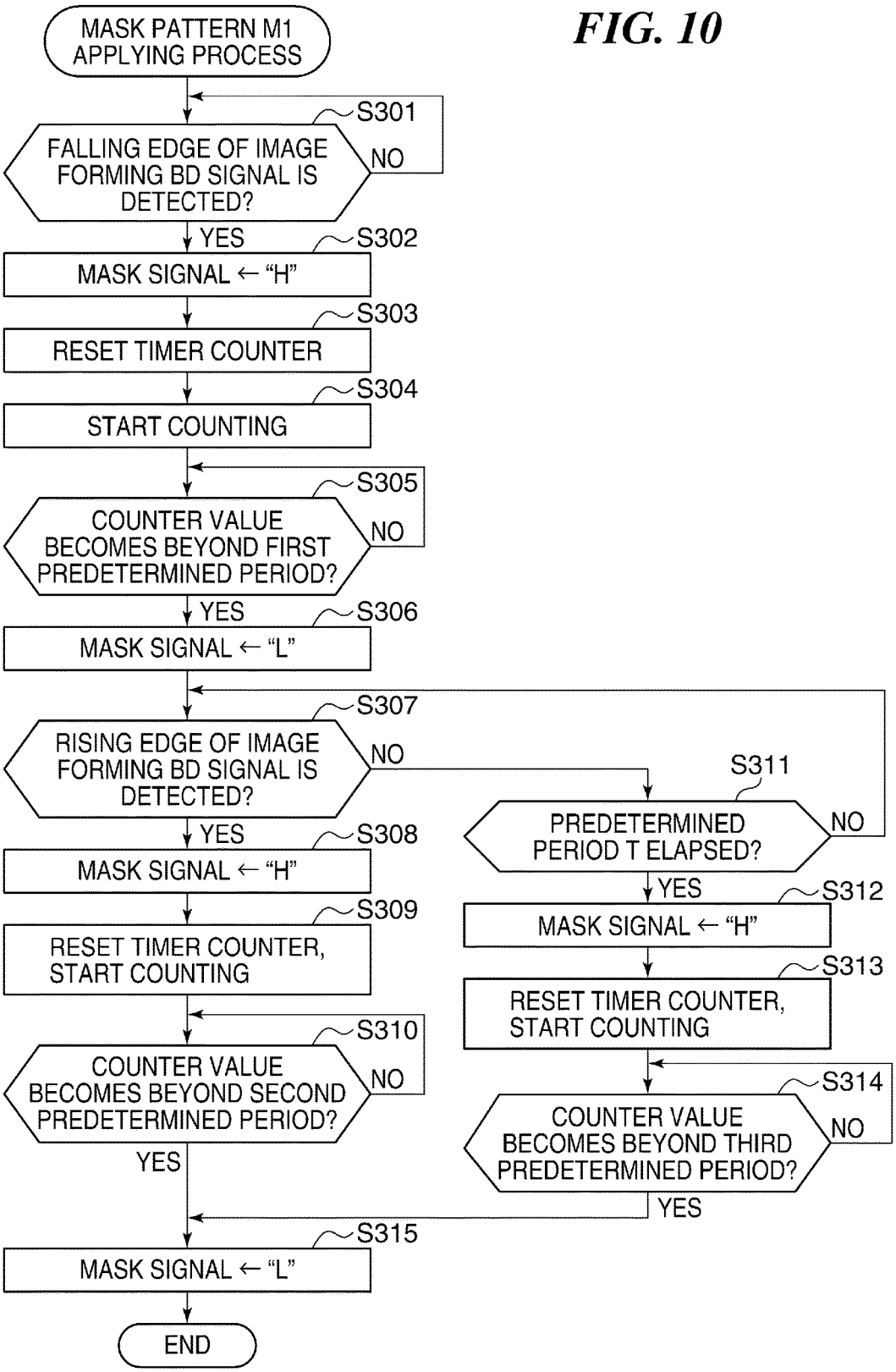
FIG. 10 is a flowchart of a mask pattern M1 application process.

FIG. 10 is a flowchart of a mask pattern M1 application process. This process is achieved when the CPU 151 reads a program stored in a storage unit (not shown) to a RAM (not shown) and runs it. This process is started when the step S202 in FIG. 9 is executed and is executed in parallel to the process in FIG. 9.

First, the CPU 151 waits until the falling edge (t2) of the image forming BD signal is detected (step S301). When the falling edge of the image forming BD signal is detected, the CPU 151 sets up the mask signal to "H" (step S302). Then, the CPU 151 resets a timer counter (step S303) and starts counting by the timer counter (step S304). After that, the CPU 151 waits until the counter value of the timer counter becomes beyond the first predetermined period (step S305). Then, when the counter value becomes beyond the first predetermined period, the mask signal is set to "L" (step S306).

Next, when detecting the rising edge (t1) of the image forming BD signal (step S307), the CPU 151 sets up the mask signal to "H" (step S308). Then, the CPU 151 resets the timer counter and starts counting (step S309). After that, the CPU 151 determines whether the counter value becomes beyond the second predetermined value (step S310). When the counter value becomes beyond the second predetermined period, the CPU 151 proceeds with the process to step S315.

In the meantime, when the falling edge (t2) of the image forming BD signal is not detected, the CPU 151 proceeds with the process to step S311. In the step S311, when the counter value is less than the predetermined period T, the CPU 151 returns the process to the step S307. In the meantime, when the counter value is beyond the predetermined period T, the CPU 151 sets up the mask signal to "H" in step S312.

Then, the CPU 151 resets the timer counter and starts counting (step S313). After that, the CPU 151 determines whether the counter value becomes beyond the third predetermined period (step S314). When the counter value becomes beyond the third predetermined period, the CPU 151 proceeds with the process to the step S315. In the step S315, the CPU 151 sets up the mask signal to "L" and finishes the process in this flowchart.

Figure 11:
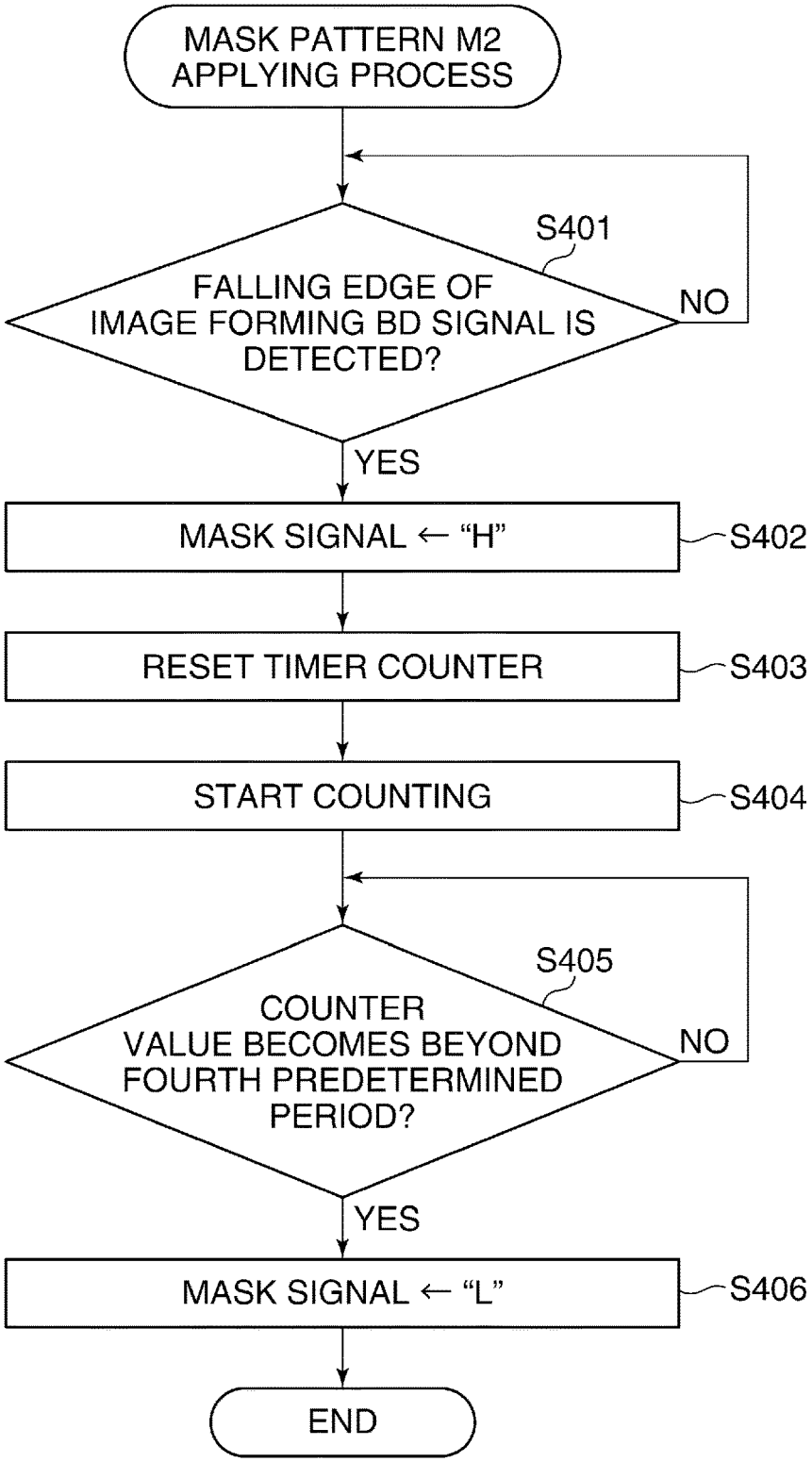
FIG. 11 is a flowchart of a mask pattern M2 application process.

FIG. 11 is a flowchart of a mask pattern M2 application process. This process is achieved when the CPU 151 reads a program stored in a storage unit (not shown) to a RAM (not shown) and runs it. This process is started when the step S206 in FIG. 9 is executed and is executed in parallel to the process in FIG. 9.

First, the CPU 151 waits until the falling edge (t2) of the image forming BD signal is detected (step S401). When the falling edge of the image forming BD signal is detected, the CPU 151 sets up the mask signal to "H" (step S402). Then, the CPU 151 resets a timer counter (step S403) and starts counting by the timer counter (step S404). After that, the CPU 151 waits until the counter value of the timer counter becomes beyond the fourth predetermined period (step S405). When the counter value becomes beyond the fourth predetermined period, the CPU 151 sets up the mask signal to "L" (step S406). Then, the CPU 151 finishes the process in FIG. 11.

According to the embodiment, the engine controller 1009 outputs the image forming BD signal generated on the basis of the output of the BD sensor so that the duration of the first level (effective duration A) corresponding to the predetermined reflection surface is different from the effective duration B corresponding to the other reflection surfaces. The CPU 151 applies the mask patterns M1 and M2 while switching for specifying the reflection surfaces. Since the engine controller 1009 is able to notify the image controller 1007 of the information about the reflection surfaces using the signal line for sending the image forming BD signal without newly providing a signal line for sending the information about the reflection surfaces to the image controller 1007 from the engine controller 1009, the image controller 1007 is able to specify a reflection surface with an inexpensive configuration.

The CPU 151 applies the mask pattern M1 until the predetermined reflection surface is specified. Then, the CPU 151 applies the mask pattern M2 after the predetermined reflection surface is specified. Thereby, the misdetection due to mixing of noise is prevented effectively while securing the measurement of the effective duration of the predetermined reflection surface and the detection of the BD cycle of each reflection surface. Accordingly, the influence of noise to the original BD signal is inhibited, and a reflection surface is specified cheaply and accurately.

From a viewpoint of noise reduction, it is not indispensable to use all the duration of the image forming BD signal obtained by changing the original BD signal except the timing t1 corresponding to the predetermined reflection surface and the timing t2 corresponding to each of the reflection surfaces as the mask period during which the signal is not obtained. For example, in the embodiment, the mask pattern M1 is formed as a continuous mask period during which the signal is not obtained except at or near the timings t1 and t2. The mask pattern M2 is formed as a continuous mask period during which the signal is not obtained except at or near the timing t2. However, the mask period during which the signal is not obtained may be intermittent. Even if the mask period is intermittent, the noise reduction effect is obtained to some extent. Alternatively, the image forming BD signal may be obtained so as not to obtain the signal corresponding to at least partial duration within the duration except the timings t1 and t2. Namely, the signal is not obtained as much as possible within the duration except the timings needed to detect the BD cycle and the effective duration. From this viewpoint, the method for providing the period during which the signal is not obtained is not limited to the method for applying the mask pattern. Moreover, the process that does not obtain a part of the signal includes a process that does not use a part of the received signal for detecting the BD cycle and the effective duration.

Although the mask patterns M1 and M2 shall be switchingly applied in this embodiment, the aspect of the disclosure is not limited to the above configuration. That is, since the signal has only to be obtained at the timings t1 and t2 and should not be obtained within duration other than the timings as much as possible, only the mask pattern M1 may be used, for example.

It should be noted that the image controller 1007 may be considered as the information processing apparatus of the present invention. In such a case, the reader (image reading device) 700 in combination with the image printing device 701 except the image controller 1007 may be considered as the image forming apparatus connected to the information processing apparatus. Alternatively, the reader (image reading device) 700 and the image printing device 701 including the image controller 1007 may be considered as the image forming apparatus of the present invention. A method for connecting the image forming unit including the laser scanner unit 707, the photosensitive drum 708, and the engine controller 1009 to the image controller 1007 that outputs image data does not matter.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-227960, filed Nov. 28, 2017, which is hereby incorporated by reference herein in its entirety.

What is claimed is:

1. An image forming apparatus comprising:

a first reception unit configured to receive image data;

a light source configured to emit light according to the image data received by the first reception unit;

a photosensitive member;

a polygon mirror that has a plurality of reflection surfaces and deflects the light emitted from the light source by using the plurality of reflection surfaces to scan the photosensitive member by rotating:

a light receiving unit configured to have a light receiving element that receives the light deflected by the polygon mirror;

a specifying unit configured to specify a reflection surface used for scanning the photosensitive member among the plurality of reflection surfaces;

a generation unit configured to generate a signal having a first level and a second level based on information about the reflection surfaces specified by the specifying unit, a period of the first level of the signal corresponding to a predetermined reflection surface among the plurality of reflection surfaces being longer than a period of the first level of the signal corresponding to the other reflection surfaces than the predetermined reflection surface;

a second reception unit configured to receive the signal;

a detection unit configured to detect a first timing at which the signal changes to the first level from the second level and a second timing at which the signal changes to the second level from the first level;

a measurement unit configured to measure a period from the first timing detected by the detection unit to the second timing that is detected first after elapsing a first period from the first timing;

an update unit configured to specify the reflection surface based on the period measured by the measurement unit and to update surface information about the reflection surfaces every time of detection of the first timing after specifying the reflection surfaces;

a storage unit configured to store a plurality of pieces of correction data that respectively correspond to a different one of the plurality of reflection surfaces in association with the surface information;

a correction unit configured to correct the image data corresponding to the reflection surface according to the surface information and the correction data stored in the storage unit; and an output unit configured to output the image data corrected by the correction unit to the image forming unit in response to detection of the first timing, wherein the first period is shorter than a period from the first timing to the second timing corresponding to the predetermined reflection surface and is longer than a period from the first timing to the second timing corresponding to the other reflection surfaces.

2. An information processing apparatus connected with an image forming apparatus including an image forming unit that includes:

a first reception unit configured to receive image data;

a light source configured to emit light according to the image data received by the first reception unit;

a photosensitive member;

a polygon mirror that has a plurality of reflection surfaces and deflects the light emitted from the light source by using the plurality of reflection surfaces to scan the photosensitive member by rotating:

a light receiving unit configured to have a light receiving element that receives the light deflected by the polygon mirror;

a specifying unit configured to specify a reflection surface used for scanning the photosensitive member among the plurality of reflection surfaces;

a generation unit configured to generate a signal having a first level and a second level based on information about the reflection surfaces specified by the specifying unit, a period of the first level of the signal corresponding to a predetermined reflection surface among the plurality of reflection surfaces being longer than a period of the first level of the signal corresponding to the other reflection surfaces than the predetermined reflection surface, the information processing apparatus comprising:

a second reception unit configured to receive the signal;

a detection unit configured to detect a first timing at which the signal changes to the first level from the second level and a second timing at which the signal changes to the second level from the first level;

a measurement unit configured to measure a period from the first timing detected by the detection unit to the second timing that is detected first after elapsing a first period from the first timing;

an update unit configured to specify the reflection surface based on the period measured by the measurement unit and to update surface information about the reflection surfaces every time of detection of the first timing after specifying the reflection surfaces;

a storage unit configured to store a plurality of pieces of correction data that respectively correspond to a different one of the plurality of reflection surfaces in association with the surface information;

a correction unit configured to correct the image data corresponding to the reflection surface according to the surface information and the correction data stored in the storage unit; and an output unit configured to output the image data corrected by the correction unit to the image forming unit in response to detection of the first timing, wherein the first period is shorter than a period from the first timing to the second timing corresponding to the predetermined reflection surface and is longer than a period from the first timing to the second timing corresponding to the other reflection surfaces.

3. The information processing apparatus according to claim 2, wherein the specifying unit specifies that the reflection surface used for scanning is the predetermined reflection surface in a case where the period measured by the measurement unit is longer than a second period.

4. The information processing apparatus according to claim 2, wherein the specifying unit determines that the reflection surface used for scanning is one of the other reflection surfaces in a case where the second timing is not detected until a second period that is longer than the first period elapses from the first timing detected by the detection unit.

5. The information processing apparatus according to claim 2, wherein the update unit updates the surface information when the detection unit detects the first timing.

6. The information processing apparatus according to claim 2, wherein the correction unit reads the correction data stored in the storage unit based on the surface information specified by the update unit and corrects the image data corresponding to the reflection surface that deflects the light that scans the photosensitive member using the correction data read.

7. The information processing apparatus according to claim 2, wherein a substrate in which the second reception unit is provided differs from a substrate in which the generation unit is provided, and wherein the substrate in which the second reception unit is provided is connected with the substrate in which the generation unit is provided through a cable.

8. The information processing apparatus according to claim 2, wherein the correction unit corrects first image data by using first correction data corresponding to a reflection surface that deflects the light output from the light source based on the first image data, and corrects second image data, which differs from the first image data, by using second correction data corresponding to a reflection surface that deflects the light output from the light source based on the second image data.

* * * * *